United States Patent [19]

Altman

[11] Patent Number: 4,680,685

[45] Date of Patent: Jul. 14, 1987

[54] LIGHT PANEL

[75] Inventor: Peter Altman, Philadelphia, Pa.

[73] Assignee: Light and Sound Specialties, Inc., Philadelphia, Pa.

[21] Appl. No.: 893,503

[22] Filed: Aug. 5, 1986

[51] Int. Cl.[4] ..... F21V 11/00

[52] U.S. Cl. ..... 362/240; 362/351

[58] Field of Search ..... 362/23, 240, 351, 355

[56] References Cited

U.S. PATENT DOCUMENTS 4,607,317 8/1986 Lin ..... 362/355

*Primary Examiner*—Stephen F. Husar

*Attorney, Agent, or Firm*—Seidel, Gonda, Goldhammer & Abbott

[57] ABSTRACT

The present invention is directed to a light panel device. The device includes a translucent plastic body having a plurality of randomly disposed holes therethrough. A lamp is placed in each hole. The lamp is at most flush with an exposed surface of the body. A fiberglass backing layer is cemented to the unexposed surface of the body. Optionally, a foil layer can be cemented to the fiberglass backing. The lamp produces a bright spot effect or halo effect depending upon the line of sight.

12 Claims, 8 Drawing Figures

FIG.5
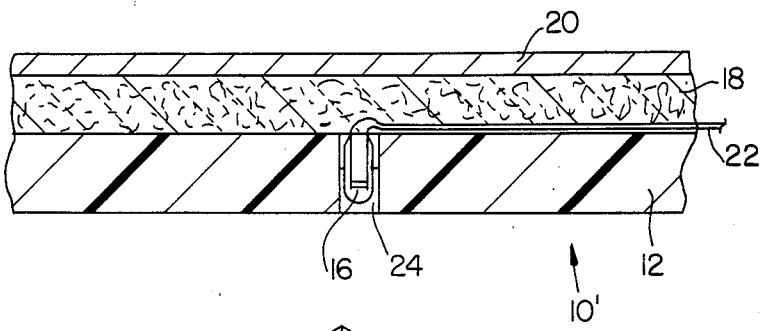
FIG.6
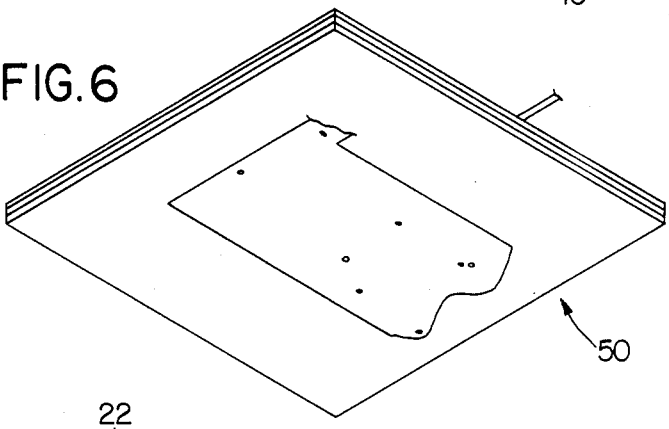
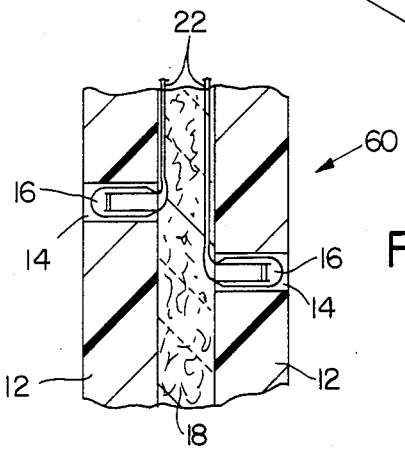
FIG. 7
FIG.8
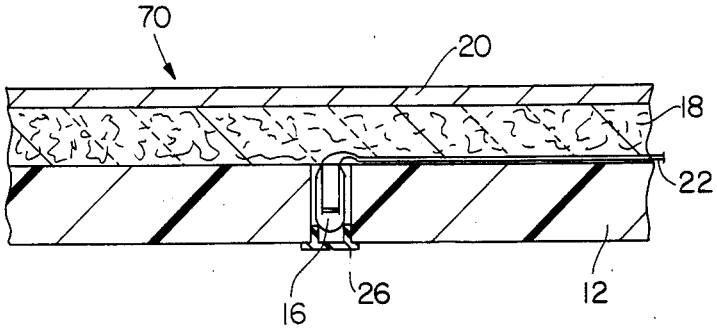

LIGHT PANEL

BACKGROUND OF THE INVENTION

This invention is directed to a light panel. Heretofore, light panels have been commercially available, for instance, the LP series LITEPANEL marketed by Lightworks, a division of Light and Sound Specialties, Inc. of Philadelphia, Pa. (the assignee of this application). This product is constructed as a sandwich comprising of a smoke-colored transparent thermoplastic layer, a molded sheet of fiberglass, and a metallic foil. A miniature, unbased incandescent lamp is sandwiched between the thermoplastic layer and the sheet of fiberglass. The thermoplastic layer is imperforate and acts as a lens.

In these prior art light panels, it was imperative that the color of the fiberglass match the color of the transparent thermoplastic. The matching colors mask the flexible wire connections between the lamps. Accordingly, an inventory of different colored fiberglass or colored dyes for the fiberglass must be maintained. Additionally because the thermoplastic layer is transparent, the lamps produce a bright spot effect without diffusion so that the panel cannot serve as a source of illumination.

U.S. Pat. No. 4,577,264 discloses a lighting panel which consists of an outer pan having side walls and an exterior surface. Miniature lamps are encapsulated in diffusing lenses which protrude through openings in the exterior surface. Each lens is made of "clear translucent" material. The lenses eliminate the bright spot effect that would otherwise be produced. The exterior surface is a specular reflector. An inner pan fits within the outer pan and is secured by fasteners, such as sheet metal screws, to the outer pan.

U.S. Pat. No. 3,309,806 discloses a translucent light diffusing plate with a grid of diode type bulbs mounted behind it. The diffusing plate may be colored if desired. The purpose of the diffusing plate is to provide uniform illumination of a lens plate bearing a symbol such as "EXIT". The bulb grid must be spaced substantially from the diffusing plate.

U.S. Pat. No. 4,254,453 discloses an alpha-numeric display comprising a grid of miniature (LED) lamps mounted on a board and protruding through a reflector board.

U.S. Pat. No. 1,761,120 discloses a lighting sign comprising a backing strip of insulating material, such as fiber.

SUMMARY OF THE INVENTION

This invention is directed to a light panel device. The device comprises a translucent thermoplastic body having at least one hole therethrough and an exposed and unexposed surface. A lamp is placed within each hole. The lamp is recessed or flush with respect to the exposed surface but does not project beyond the surface. A fiberglass backing material is cemented to the unexposed surface.

When the line of sight to the lamp is coaxial with the hole, a bright spot effect is produced. As the angle of the line of sight is varied so as to approach the plane of the outer surface of the translucent body, a halo effect is observed. The halo produced has the same color as the translucent body. Thus, varying the angle of the line of sight produces an animated lighting effect without electrical hardware such as a light controller.

A further advantage of the present invention is that any color translucent body may be used. Since the body is translucent, it naturally hides any wires interconnecting the lamps and masks the color of the fiberglass backing material.

The present invention can be used in night clubs, bars, retail stores, daytime restaurants, billboard backdrops, signs, malls, theatres, conference areas, etc.

DESCRIPTION OF THE DRAWINGS

For the purpose of illustrating the invention, there is shown in the drawings a form which is presently preferred it being understood, however, that this invention is not limied to the precise arrangements and instrumentalities shown.

FIG. 5 is a sectional view of an alternate embodiment of the present invention.

FIG. 6 is an isometric view of an alternate embodiment of the present invention.

FIG. 7 is a sectional view of an alternate embodiment of the present invention.

FIG. 8 is a sectional view of an alternate embodiment of the present invention.

DETAILED DESCRIPTION OF THE INVENTION

Figure 1:
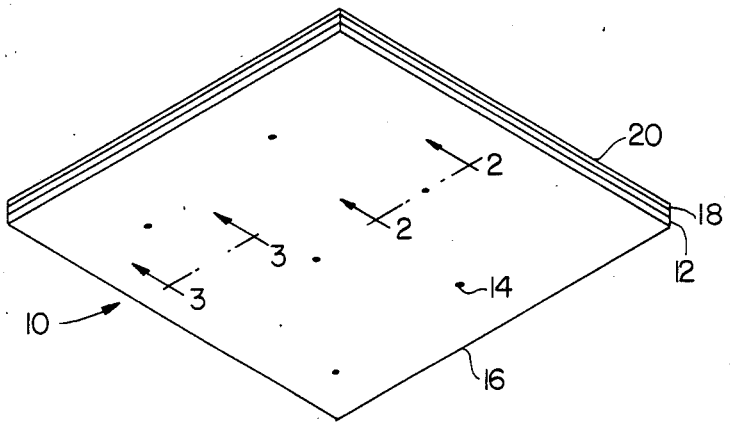
FIG. 1 is an isometric view of an embodiment of the present invention.
Figure 2:
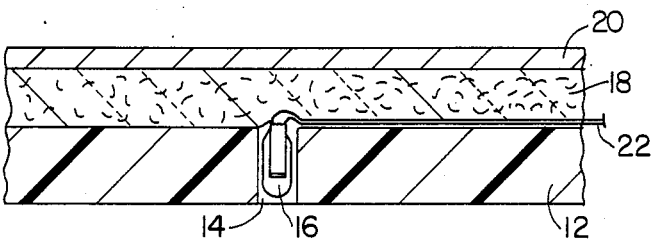
FIG. 2 is a sectional view taken along lines 2—2 of FIG. 1.
Figure 3:
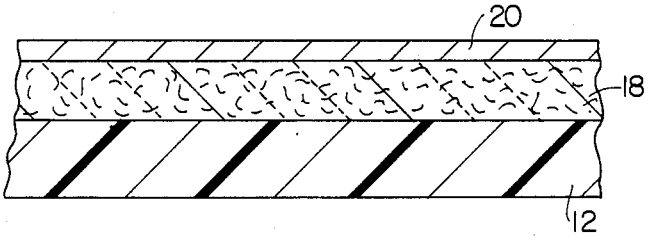
FIG. 3 is a sectional view generally taken along lines 3—3 of FIG. 1.

Referring to the drawings wherein like numerals refer to like elements, there is shown in FIG. 1 an embodiment of the present invention designated 10.

The light panel 10 is preferably rectangular in shape and can be used to cover walls or ceilings. Of course, the present invention is not limited to rectangular or planar embodiments. As will be apparent to those of ordinary skill in the art, any geometric or three-dimensional shape can be utilized.

The light panel 10 comprises a body 12, a fiberglass backing layer 18 and preferably a metallic foil layer 20. The fiberglass backing layer 18 is sandwiched between body 20 and foil layer 20. The layers are joined together, for example by cementing. Preferably, the cement is a glue which is sprayed onto the mating surface of the respective layers.

The body 12 includes at least one hole 14. Preferably, there are a plurality of randomly distributed holes 14 extending through the body 12. The body 12 is made of a translucent plastic material, such as polycarbonate or acrylic. Of course, it is understood that any thermoplastic material is suitable. The surface of the body 12 which is not cemented to the fiberglass layer 18 is called the exposed layer. The surface of the body 12 which is cemented to the fiberglass layer is called the unexposed layer.

The fiberglass backing layer 18 is a conventional fiberglass insulating-type material. Metallic foil layer 20 provides a moisture seal but is optional.

A miniature unbased incandescent lamp 16 is placed in each hole 14. The lamp 16 can be recessed from or flush with the exposed surface of body 12; it does not extend out of hole 14 beyond the exposed surface. Electrical wires 22 which are connected to each lamp 16 are preferably placed between the body 12 and fiberglass backing layer 18.

Figure 4:
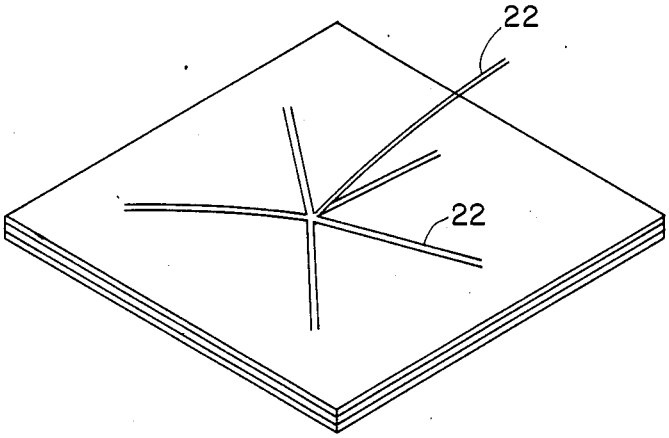
FIG. 4 is an isometric view of the present invention, parts broken away for clarity.

The lamps 16 may be interconnected to one another in either a parallel circuit (see FIG. 4) or a series circuit (not shown), or by more than one circuit within or without the same panel.

A transparent silicone gel 24 may be used to seal lamp 16 within holes 14. See FIG. 5. The gel 24 is for waterproofing and plugs the hole 14. The gel 24 is preferably flush with the exposed surface.

Embodiment 50 illustrates an irregular non-planar surface made according to the present invention. The exposed surface has a relief map thereon. See FIG. 6.

In FIG. 7, embodiment 60 is shown. The foil layer 20 is eliminated and fiberglass layer 18 is sandwiched between two translucent bodies 12. Each body 12 has at least one hole 14.

In FIG. 8, an embodiment 70 is shown. A cap 26 plugs the hole 14. The cap 26 is made of a transparent plastic material. The cap 26 is for waterproofing the light panel.

The present invention may be embodied in other specific forms without departing from the spirit or essential attributes thereof and, accordingly, reference should be made to the appended claims, rather than to the foregoing specification, as indicating the scope of the invention.

What is claimed is:

1. A light panel device comprising:

a thermoplastic translucent body having at least one hole therethrough and an exposed and an unexposed surface;

a lamp placed within each hole so as not to project beyond the exposed surface; and a fiberglass backing layer secured to the unexposed surface.

2. The device according to claim 1 further comprising a foil layer, said fiberglass backing layer being sandwiched between said body and said foil layer.

3. The device according to claim 1 wherein said lamp is recessed with respect to said exposed surface.

4. The device according to claim 1 wherein said translucent body is made of polycarbonate.

5. The device according to claim 1 wherein said device is planar.

6. The device according to claim 1 wherein said lamp is an incandescent lamp.

7. The device according to claim 3 further comprising a silicone gel plugging said hole and substantially flush with said exposed surface.

8. The device according to claim 3 further comprising a cap which plugs said hole.

9. The device according to claim 1 wherein electric wires are sandwiched between said body and said fiberglass layer.

10. The device according to claim 1 further comprising a second thermoplastic translucent body having at least one hole therethrough and an exposed and an unexposed surface, said fiberglass backing layer being sandwiched between said bodies.

11. A light panel device comprising:

a translucent thermoplastic body having at least one hole therethrough and an exposed and an unexposed surface;

an incandescent lamp placed within each hole so as not to project beyond the exposed surface; and a fiberglass backing layer secured to the unexposed surface.

12. The device according to claim 11 further comprising a foil layer, said fiberglass backing layer being sandwiched between said body and said foil layer.

* * * * *